US006276060B1

(12) United States Patent
Faulstich et al.

(10) Patent No.: US 6,276,060 B1
(45) **Date of Patent: *Aug. 21, 2001**

(54) DRY SHAVING APPARATUS

(75) Inventors: Helmut Faulstich, Frankfurt; Michael Klotz, Schöneck, both of (DE)

(73) Assignee: Braun Aktiengesellschaft, Frankfurt am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,517

(22) Filed: Mar. 11, 1998

Related U.S. Application Data

(63) Continuation of application No. PCT/EP96/02674, filed on Jun. 20, 1996.

(30) Foreign Application Priority Data

Oct. 18, 1995 (DE) ..... 195 38 730

(51) Int. Cl.[7] ..... B26B 19/38
(52) U.S. Cl. ..... 30/34.1; 30/43.92
(58) Field of Search ..... 30/34.1, 201, 34.05, 30/43.92

(56) References Cited

U.S. PATENT DOCUMENTS

| | | | | |
|---|---|---|---|---|
| 2,517,999 | * | 8/1950 | Giorgi . | |
| 2,593,168 | * | 4/1952 | Monyhan . | |
| 4,085,503 | | 4/1978 | Beck et al. | 30/34.1 |
| 4,125,940 | | 11/1978 | Ihaz et al. | 30/220 |
| 4,557,050 | * | 12/1985 | Haraguchi et al. | 30/195 |
| 4,581,822 | * | 4/1986 | Fujimura | 30/216 |
| 4,614,036 | | 9/1986 | Haraguchi | 30/200 |
| 4,669,189 | * | 6/1987 | Ulmann | 30/201 |
| 4,776,095 | * | 10/1988 | Tsujimoto et al. | 30/201 |
| 5,050,305 | * | 9/1991 | Baker et al. | 30/201 |
| 5,054,199 | | 10/1991 | Ogawa et al. | 30/34.1 |
| 5,084,973 | * | 2/1992 | Geer | 30/133 |
| 5,084,974 | * | 2/1992 | Sukow et al. | 30/201 |
| 5,185,931 | * | 2/1993 | Fujikawa et al. | 30/201 |
| 5,507,095 | * | 4/1996 | Wetzel et al. | 30/34.1 |
| 5,604,985 | * | 2/1997 | Andis et al. | 30/132 |
| 5,699,616 | * | 12/1997 | Ogawa | 30/201 |

FOREIGN PATENT DOCUMENTS

| | | |
|---|---|---|
| 446264 | 6/1927 | (DE) . |
| 876368 | 3/1953 | (DE) . |
| 3246258A1 | 6/1983 | (DE) . |
| 3441060 C2 | 6/1985 | (DE) . |
| 4039681A1 | 7/1991 | (DE) . |
| 2245211A | 1/1992 | (GB) . |
| 62-246397 | 10/1987 | (JP) . |

OTHER PUBLICATIONS

International Search Report.
Translation of JP 62–246397.

* cited by examiner

*Primary Examiner*—M. Rachuba
(74) *Attorney, Agent, or Firm*—Fish & Richardson P.C.

(57) ABSTRACT

The invention is directed to a dry shaving apparatus or hair cutting apparatus with a housing (G), with an electric drive mechanism and with at least one cutter assembly (LS) comprised of cooperating cutter blades combining to form a cutting edge (S), and with a spacer comb (12) having at least one engagement surface (70, 80, 90) or engagement line (100) associated with the cutting edge (S) and formed by tines (23), with a relative distance to the cutting edge (S) being adjustable by displacement of the engagement surface (70, 80, 90) or engagement line (100), wherein at least two engagement surfaces (70, 80) or engagement lines (100) are available whose relative distances to the cutting edge (S) are variable such that said distances are equal.

32 Claims, 5 Drawing Sheets

DRY SHAVING APPARATUS

This application is a continuation of PCT/EP96/02674, filed Jun. 20, 1996.

This invention relates to a dry shaving apparatus or hair cutting apparatus with a housing, with an electric drive mechanism and with at least one cutter assembly comprised of cooperating cutter blades combining to form a cutting edge, and with a spacer comb having at least one engagement surface associated with the cutting edge and formed by tines, with a relative distance to the cutting edge being adjustable by displacement of the engagement surface or engagement line.

From DE 34 41 060 A1 a hair cutting apparatus is known having a cutter assembly comprised of cooperating cutter blades and a spacer comb slidably arranged on the housing of the hair cutting apparatus. The spacer comb is comprised of a tubular section and tines that are integrally formed with the tubular section and have legs approximately parallel with the plane of the stationary blade of the cutter assembly, the legs forming an acute angle with upper legs of the tines and combining with them to form a leading edge parallel to the cutting edge. The tines extending parallel to the lower plane of the blade provide a what is referred to as engagement surface whose relative distance to the cutter assembly is variable by displacement of the spacer comb such as to lock into various positions while the relative distance of the cutter assembly to the upper legs of the tines is maintained unchanged.

From Japanese patent application 62-246397 A1 a hair cutting apparatus is known having a spacer comb that is slidably arranged for locking engagement in various positions. The spacer comb is comprised of a tubular section as well as a contiguous second section formed of tines and surrounding the cutter assembly of the hair cutting apparatus. This second section formed of tines extends at an acute angle to the rear section equally formed of tines which is oriented parallel to the stationary blade of the cutter assembly. Both sections are suited for use as engagement surface for the cutting of hair. However, in this known hair cutting apparatus the relative distance of the cutting edge of the cutter assembly to the first section is designed to be greater than to the second section. As a result, on displacements of the spacer comb from one setting into a further one of the settings provided, different relative distances of the one engagement surface and the other engagement surface to the cutting edge of the cutter assembly are produced.

From U.S. Pat. No. 4,125,940 it is known to vary the distance of the two angularly extending engagement surfaces of a spacer comb relative to the cutting edge of the cutter assembly by fitting the spacer comb in a first or second push-on position provided on the housing of the hair cutting apparatus, with the desired distance being set along a spatial axis extending through the cutting edge.

It is an object of the present invention to improve a dry shaving apparatus or a hair cutting apparatus in such a way that the hair remaining on the user's head is cut to a uniform length at any setting and engagement position relative to a skin surface to which the spacer comb is adjusted.

According to the present invention, this object is accomplished in an apparatus of the type referred to in claim 1 by the features indicated in the characterizing portion of this claim.

The invention embodying the solution as disclosed in claim 1 enables the use of spacer combs having one or several engagement surfaces and ensures that the engagement surfaces which are provided on a spacer comb of a dry shaving apparatus or a hair cutting apparatus for the cutting of hair, on setting to any cutting length, cause the hair to be cut to the set cutting length uniformly, regardless of the particular position of the spacer comb relative to the skin surface in which the spacer comb is guided over the user's skin surface.

In a preferred embodiment of the present invention, the relative distances of the engagement surfaces to the cutting edge are of like magnitude in the initial position of the spacer comb. It is an essential advantage of this embodiment that it enables the user to be cut to an extremely short and at the same time uniform length immediately open setting the apparatus in operation.

In an embodiment of the present invention in which the spacer comb has at least two engagement surfaces, the engagement surfaces are slidable substantially along their bisector. This approach enables a plurality of different cutting lengths and ensures, upon adjustment or presetting of a particular cutting length, a uniform hair cut on the user. Depending on the predetermined setting, it is possible in this manner to cut a beard that has been allowed to grow over one or several days, such as four or five days, to a uniform length.

In a preferred embodiment of the present invention, the engagement surface is formed by the envelope surface of a cylinder.

In a preferred embodiment of the present invention, the relative distance of the engagement surface to the cutting edge is infinitely variable. In an alternative aspect of this embodiment, provision is made for the relative distance of the engagement surface to the cutting edge to be variable in steps. A very simple and effective embodiment of the present invention is characterized in that the engagement surface is of an arcuate configuration. In an alternative embodiment, the engagement surface is of an L-shaped configuration. A still further embodiment is characterized in that the engagement surface is of a planar configuration.

In a preferred embodiment of the present invention, the spacing of the engagement surface is adjustable by means of a control device. According to a preferred embodiment of this invention, the variation of the spacing of the engagement surface by means of a control device may be accomplished simply by forming the control device of components of the spacer comb or an actuating member associated therewith. In a further aspect of this embodiment, the spacer comb is formed of a housing, a movably mounted comb attachment incorporating the tines, the actuating member, detent members and control members. This spacer comb is designed to be an accessory for a shaver or a hair cutter, for example, but it may also be a component part of a shaver or a hair cutter.

To produce a uniform distance of one or several engagement surfaces relative to the cutting edge in a relatively simple manner, the control members provided in the spacer comb comprise control grooves extending obliquely to the vertical direction Y as well as obliquely to the horizontal direction X, and control cams slidably guided in the control grooves. For variation of the relative distance of the engagement surface(s) to the cutting edge, an obliquely extending control groove is provided in a front panel of the comb attachment, and a control cam engaging within this control groove is provided on the actuating member. To obtain at the same time a uniform distance of one several engagement surfaces relative to the cutting edge, two control cams are preferably provided on the narrow side walls of the comb attachment for engagement with the control grooves extending obliquely to each other. In a further aspect of this embodiment, the obliquely extending control grooves are provided in opposed narrow side walls of a control plate insertable into the housing.

For perfect guiding of the actuating member, the control plate includes a horizontally extending slot for engagement with a control cam provided on the actuating member. A very simple positioning of the tines of the spacer comb at different relative distances to the cutting edge is accomplished in that cooperating detent members are provided on the control plate and on the actuating member. Preferably, the detent members on the control plate are configured as notches. Correspondingly, the detent members on the actuating member are formed of a bow part provided with detent noses. A further benefit afforded by the present invention is that the spacer comb is at the same time suited for use as a guard member for the long-hair trimmer, and that the spacer comb has integrally formed thereon a guard member for the short-hair cutter of a dry shaving apparatus.

A further significant advantage of the present invention results in that at least one end of the engagement surface formed by the respective engagement surfaces of the tines is configured as a tooth. With this approach of the invention, the hair, in particular hair that lies across, is threaded into the cutting area by means of the two tips of the teeth of the tines in order to be cut off there by the cutting edge of the cutter blades. In a preferred embodiment of the present invention, each tine has at least one tooth forming the boundary for the engagement surface.

Preferably, the spacer comb has two rows of tines. In a further aspect of this embodiment, one of the two rows of the parallel tines is adjustable in both the direction X and the direction Y.

Embodiments of the present invention will be described in the following and illustrated in the accompanying drawing. In the drawing, FIG. 1 is a side view of a dry shaving apparatus having a short-hair cutter K and a long-hair trimmer LS that is vertically slidable in and in opposition to the direction of the arrow A;

Figure 8:
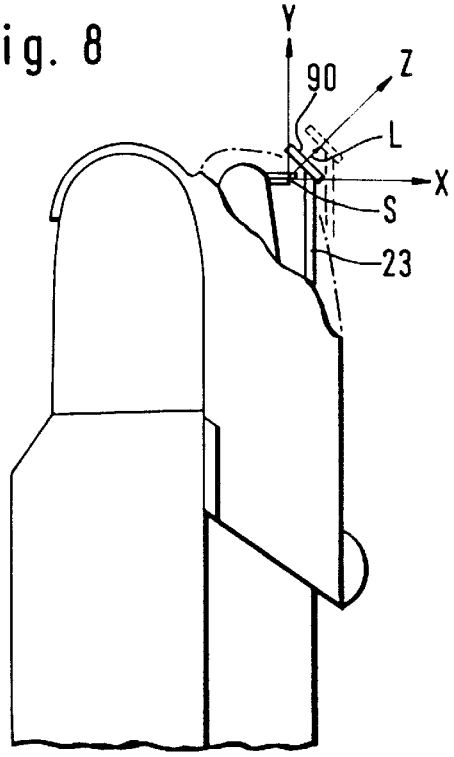
Figure 9:
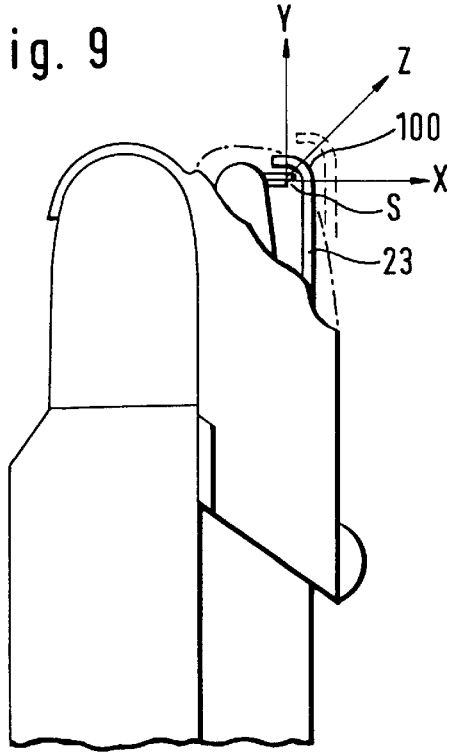

FIG. 8 is a side view of the upper part of a dry shaving apparatus showing the spacer comb seated thereon and an opening in the area of the cutting edge and a planar engagement surface; and FIG. 9 is a side view of the upper part of a dry shaving apparatus showing the spacer comb seated thereon and an opening in the area of the cutting edge, and an engagement surface of arcuate shape associated with the cutting edge.

Figure 2:
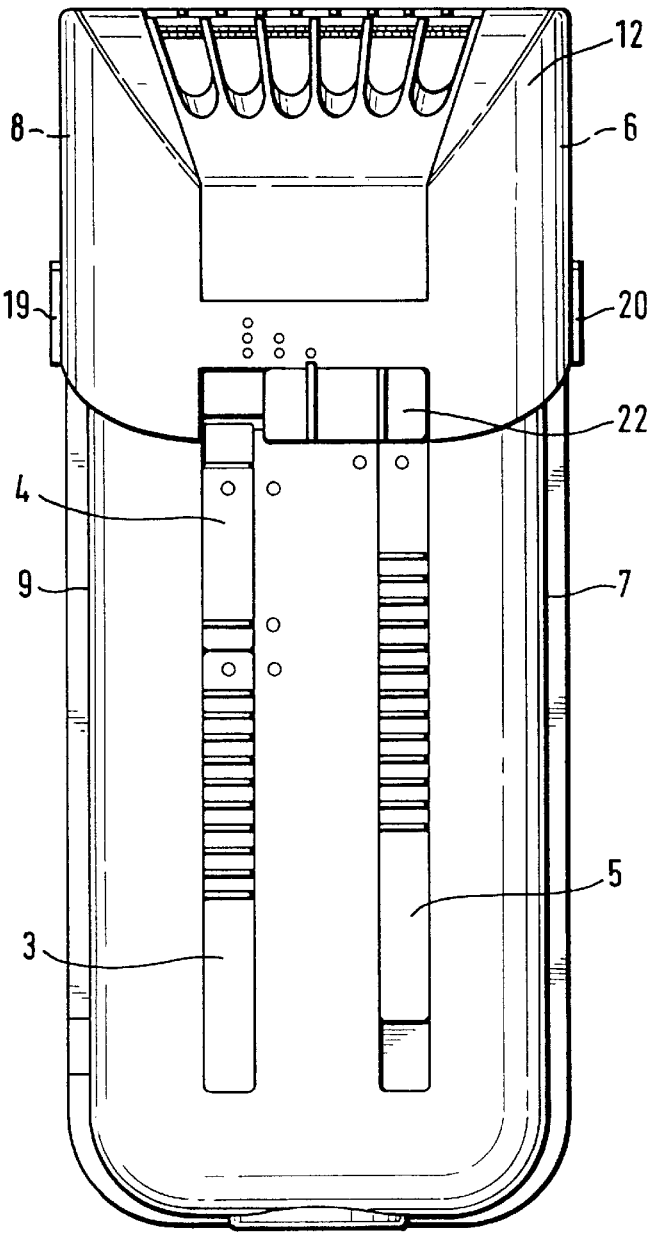
FIG. 2 is a side view of a dry shaving apparatus with a spacer comb mounted thereon and with actuating members for the dry shaving apparatus and for the spacer comb.
Figure 1:
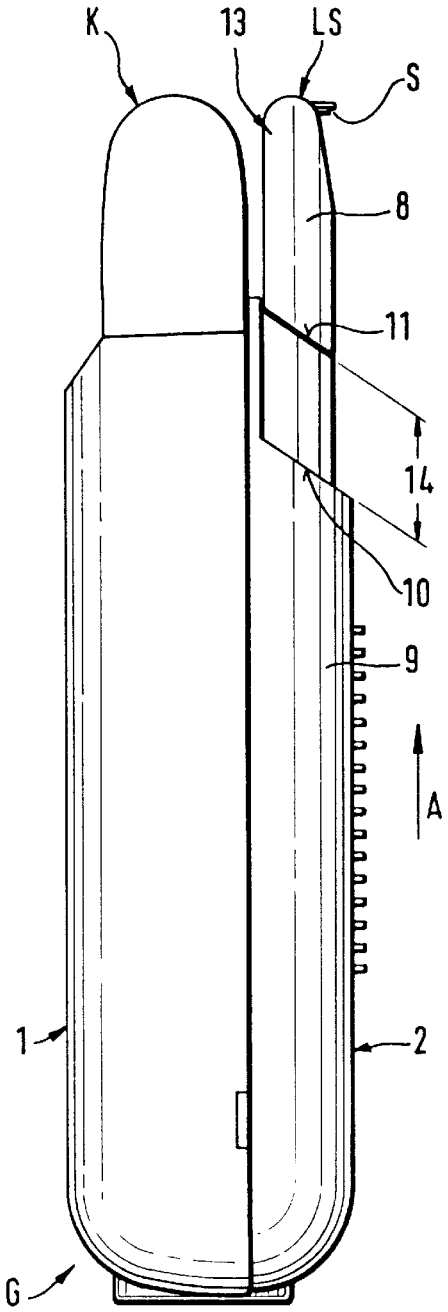

Referring now to FIG. 1 of the drawing, there is shown in a side view an electric dry shaving apparatus with a short-hair cutter K and a long-hair trimmer LS as well as a housing G receiving electrical and mechanical drive elements and comprising a first housing shell 1 and a second housing shell 2. The first housing shell 1 accommodates the electrical and mechanical drive mechanism—not shown—for the short-hair cutter K. The second housing shell 2 that is coupled to the first housing shell 1 receives in its interior a long-hair trimmer LS adjustable to various positions and—see FIG. 2—an actuating member 3 for turning the dry shaving apparatus on and off, an actuating member 4 for locking the actuating member 3 in the Off position, and an actuating member 5 for setting the long-hair trimmer LS in operation and adjusting it to at least one cutting position, for example, a cutting position located at the level of the contour of the short-hair cutter K. The opposed narrow side walls 7 and 9 of the second housing shell 2 and the opposed narrow side walls 6 and 8 of the long-hair slide 13 provided with the cutter blades of the long-hair trimmer LS are each provided with obliquely extending stepped shoulders 10, 11 causing, on a displacement of the long-hair trimmer LS from a lower initial position into the topmost position level with the outer contour of the short-hair cutter K, a respective detent opening 14 to be formed for locking engagement with detent members 15, 16 provided on the inside of the spacer comb 12 in order to secure the spacer comb 12 in place on the housing G of the dry shaving apparatus.

Figure 3:
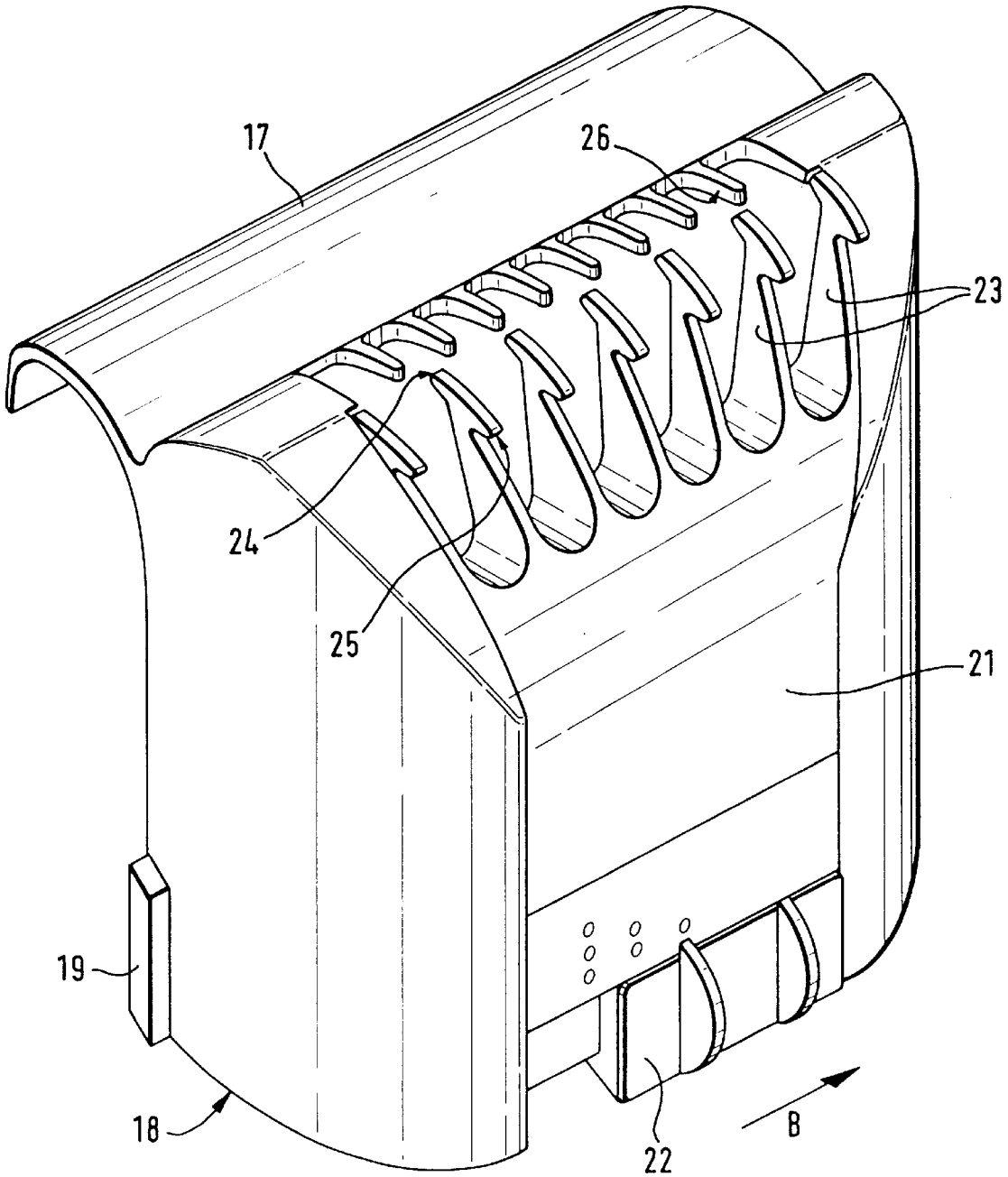
FIG. 3 is a perspective view of a spacer comb with a guard member integrally formed thereon for guarding the short-hair cutter of the dry shaving apparatus.

FIG. 3 shows the housing 18 of the spacer comb 12 with an integrally formed guard member 17 for guarding the short-hair cutter K of the dry shaving apparatus. Formed on either narrow side wall of the housing 18 are gripping members 19 and 20—see FIG. 2—in order to facilitate the mounting and dismounting of the spacer comb 12 on and from the housing G of the dry shaving apparatus. The front panel of the spacer comb 12 is configured as a comb attachment 21 arranged so as to be slidable in two different directions simultaneously by means of a horizontally movable—in and in opposition to the direction of arrow B—actuating member 22. Several tines 23 are provided at the end of the comb attachment 21 remote from the actuating member 22. The ends of the tines 23 are equipped with teeth 24 and 25 acting in at least two directions. Parallel to the tines 23 or the comb teeth 24 and 25 provided thereon, a further row of tines 26 is formed in the upper wall of the housing 18 which, with a spacer comb 12 mounted on the housing G of a dry shaving apparatus, are at an invariable distance to the long-hair trimmer LS, in particular to its cutting edge S.

Figure 4:
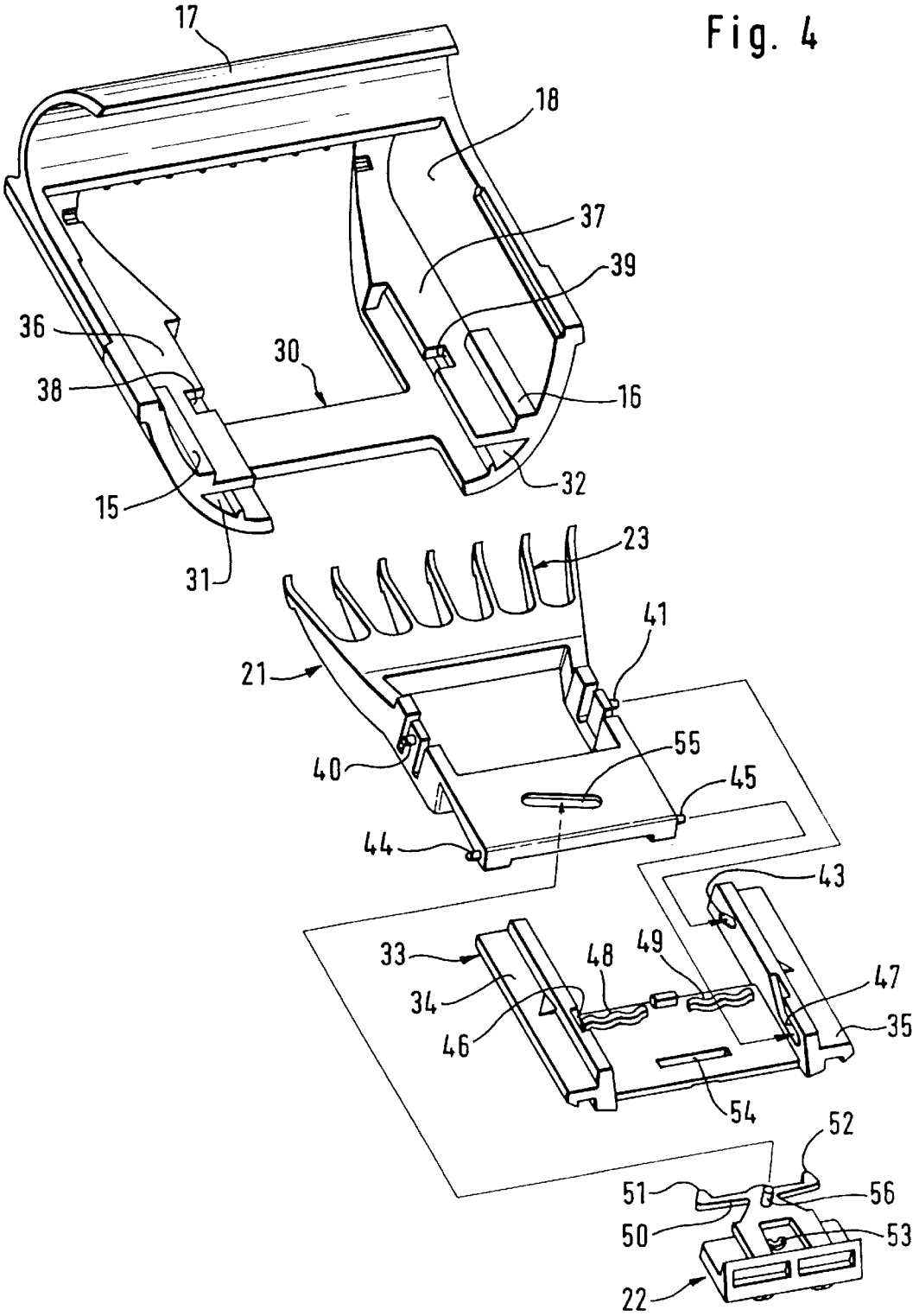
FIG. 4 is an exploded view of components of the spacer comb of FIG. 3.

FIG. 4 shows a perspective view of the spacer comb 12 as seen looking at the inside of the spacer comb 12. The housing 18 provided with a guard member 17 has an opening 30 for receiving the comb attachment 21, and has recesses 31 and 32 for guiding a control plate 33 adapted to be coupled to the comb attachment 21 by means of guide rails 34 and 35 provided on the control plate 33. Provided in the strip-type wall elements 36 and 37 of the recesses 31 and 32 are openings 38 and 39 for insertion and coupling of the control cams 40 and 41 formed on the narrow side walls of the comb attachment 21 to the control grooves 42 and 43 formed in the control plate 33—see FIGS. 5 and 6. At the end of the comb attachment 21 remote from the tines 23, a respective control cam 44 and 45 extends from the comb attachment's narrow side walls, which cams, following coupling of the comb attachment 21 to the control plate 33, are slidably carried in the control grooves 46 and 47 provided in the guide rails 34 and 35.

Formed on the inside of the control plate 33 are two detent members 48 and 49 having several notches for engagement with detent noses 51 and 52 that are disposed on a resilient bow part 50. The resilient bow part 50 is a component part of the actuating member 22 or is secured thereto. The actuating member 22 further includes a control cam 53 which, upon coupling of the actuating member 22 to the control plate 33, engages in an elongate slot 54 extending perpendicularly to the longitudinal dimension of the control plate 33 for guiding the actuating member 22. A further control cam 56 is provided on the bow part 50 of the actuating member 22. With the actuating member 22, the control plate 33 and the comb attachment 21 in assembled condition inside the housing 18, the control cam 56 engages in a control groove 55 provided in the comb attachment 21 and extending obliquely to the comb attachment's longitudinal dimension, causing on displacement of the actuating member 22 into and in opposition to the direction of arrow B—see FIG. 3—a displacement of the comb attachment 21 into and in opposition to the direction of arrow A—see FIG. 1.

Figure 6:
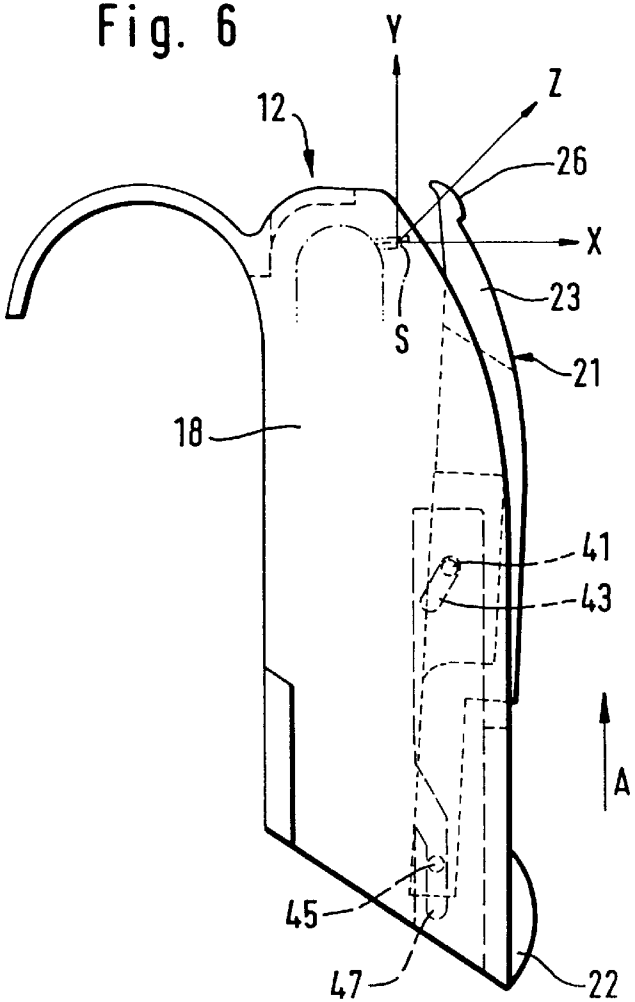
FIG. 6 is a side view of the spacer comb of FIG. 5 including control members for a uniform and simultaneous adjustment of the engagement surface relative to the cutting edge.
Figure 5:
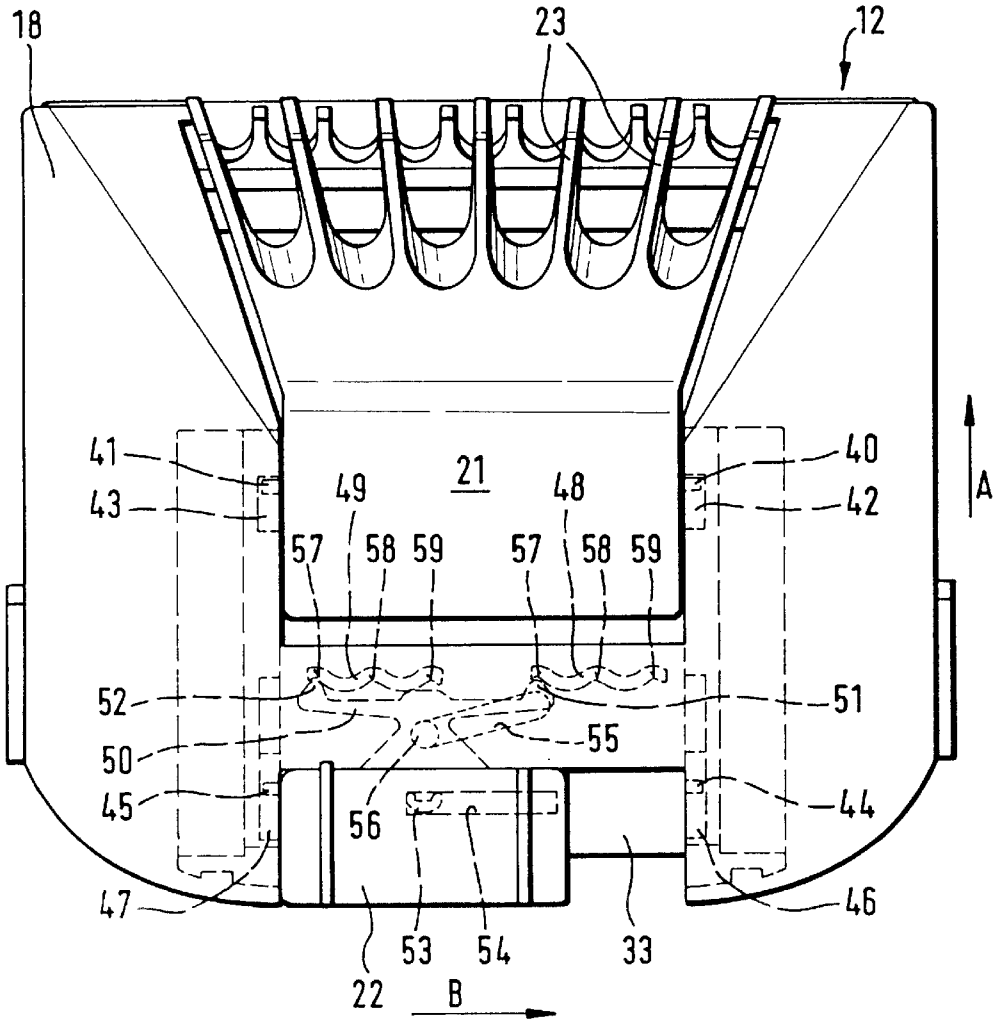
FIG. 5 is a front view of the spacer comb of FIGS. 2 to 4 including detent members and control members for varying the relative distance of the engagement surface to the cutting edge of the cutter assembly.

FIG. 5 shows the front panel of the spacer comb 12 with the housing 18 and the comb attachment 21 slidably mounted therein, the actuating member 22 and the control plate 33. Further functional elements required for both displacing and holding the comb attachment 21 in a locked position—see FIG. 4—are illustrated in FIG. 5 and FIG. 6 by broken lines, because these functional elements are provided or integrally formed essentially on the inside of the spacer comb 12 and in wall elements of the housing 18. The actuating member 22 and the spacer comb 12 with its tines 23 are shown in a position that is determined by the widest distance of the outer engagement surfaces of the teeth on the tines 23 relative to a cutting edge formed by two cooperating cutter blades—as will be explained in more detail in the following with reference to FIGS. 6 to 10. With the actuating member 22 in this position, the detent noses 51 and 52 are in engagement with the notches 57 of the detent members 48 and 49. The control cam 53 provided on the actuating member 22 is in engagement with the slot 54 provided in the control plate 33, while the control cam 56 integrally formed on the bow part 50 is in engagement with the obliquely extending control groove 55 in the comb attachment 21. The control cams 40 and 41 formed on the comb attachment 21 are in engagement with the control grooves 42 and 43 extending obliquely to a vertical direction—direction of arrow A. The control cams 44 and 45 formed on the lower end of the comb attachment 21 are in engagement with the vertically extending control grooves 46 and 47.

By means of displacement of the actuating member 22, the detent noses 51 and 52 on the resilient bow part 50 are moved into one of the notches 57, 58 or 59, for example, into the notch 57. In this detent position, the comb attachment 21 occupies, for example, the position illustrated in FIG. 6. In the course of movement of the actuating member 22 in the direction of arrow B, the actuating member 22 is guided in the slot 54 via the control cam 53. At the same time, the control cam 56 acts on the obliquely extending side walls of the control groove 55 of the comb attachment 21, thus moving the comb attachment 21 in the vertical direction in opposition—direction of arrow A.

Control of the movement of the comb attachment 21 in the coordinate axes X and Y—see FIG. 6—is effected not only through the sliding motion of the control cams 44 and 45 in the vertically extending—direction of arrow A—control grooves 46 and 47, but also through the control grooves 42 and 43 formed in the control plate 33 and extending obliquely to the vertical direction —direction of arrow A, in which grooves the comb attachment 21 is slidably guided by means of the control cams 40 and 41. The oblique extension of the control grooves 42 and 43 relative to the X and Y axis of the respective coordinate system illustrated in FIGS. 6 to 9 has such an orientation that the spacing of the engagement surface(s) 70, 80, 90, 100 of the respective comb attachments 21 with their different geometrical shapes is uniformly variable in the directions X and Y. As shown in FIGS. 6–9, the x axis is parallel to a plane passing between the cutting blades.

The embodiment of the spacer comb 12 of FIG. 6 shows a comb attachment 21 with tines 23 on which teeth 26 are provided. The outer surface of the teeth 26 engaging a user's skin is configured in the manner of the arc of a circle, for example, forming part of the envelope surface of a cylinder. Accordingly, the relative distance of the engagement surfaces 100 to the point of intersection of the coordinate axes X and Y is of like magnitude. The point of intersection of the coordinate axes X and Y is determined by the cutting edge S of two cooperating cutter blades equipped with cutting teeth which are known to be referred to as long-hair trimmer LS.

Figure 7:
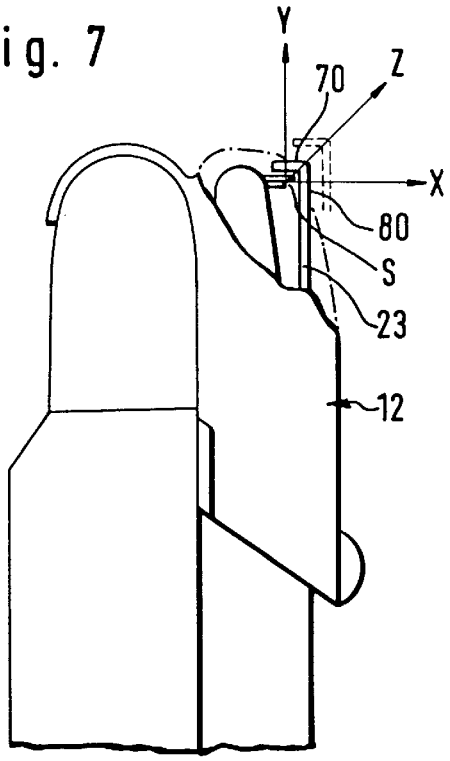
FIG. 7 is a view of the upper part of a dry shaving apparatus showing the spacer comb seated thereon and an opening in the area of the long-hair trimmer and an engagement surface of L-shaped configuration associated with the cutting edge.

The embodiments of FIGS. 7 to 9 differ from the embodiment of FIG. 6 only by a different geometrical configuration of the tines 23 in the area of the skin engagement surface(s) 70, 80, 90, 100. The relative distance of engagement surfaces 70, 80 FIG. 7—or of one engagement surface 90—FIG. 8—or 100 FIG. 9—to the cutting edge S of the long-hair trimmer LS comprised of a cutter comb and a cutter blade is of like magnitude in the initial position which is defined by the shortest distance of the engagement surface 90 or engagement surfaces 70, 80 or 100 to the cutting edge S. In the embodiment of FIG. 7, the tines 23 of the spacer comb 12 have two engagement surfaces 70 and 80 which are arranged at right angles to each other as in L-shape, for example. To ensure a uniform distance of both engagement surfaces 70 and 80 to the cutting edge S as the relative distance of the engagement surfaces 70 and 80 to the cutting edge S is varied, both engagement surfaces 70, 80 are to be displaceable substantially along their bisector represented by the coordinate axis Z. With the engagement surfaces 70 and 80 arranged at right angles to each other, the bisector is at 45°. Where the engagement surfaces 70 and 80 form an acute or obtuse angle with one another, the bisector has to be determined and the comb attachment 21 to be displaced in accordance with the direction in which this bisector extends. This is ensured by providing for the control grooves 42 and 43 to extend in the control plate 33 obliquely, in conformity with the direction in which the bisector extends.

FIG. 8 shows an embodiment with an engagement surface 90 that is oriented obliquely to the cutting edge S in relation to the coordinates X, Y of the coordinate system. To ensure a uniform distance of the engagement surface 90 to the cutting edge S as the relative distance of the engagement surface 90 to the cutting edge S is varied, the engagement surface 90 on the comb tines has to be positioned in such fashion that a perpendicular L dividing the engagement surface 90 in two halves extends through the cutting edge S, and the displacement of the engagement surface 90 proceeds in the direction of the perpendicular L. The displacement of the engagement surface 90 in the direction of the perpendicular L is controllable by a corresponding angular extension of the control grooves 42 and 43 in relation to the coordinate axes X and Y—see FIG. 6.

In the embodiment of FIG. 9, the area of the comb tines engaging the skin surface is configured as the envelope surface of a cylinder surrounding, for example, the cutting edge S formed by the cutter blades in an essentially semicircular configuration. The cylindrical envelope surface forms the engagement surface 100. The relative distance of the engagement surface 100 to the cutting edge S corresponds to the radius of the cylindrical envelope surface. In this embodiment, the cylindrical envelope surface is to be displaced along the coordinate axis Z whose direction is determined by the bisector of the coordinate system formed of the coordinate axes X and Y in order to cut the hair to a uniform length.

What is claimed is:

1. A dry shaving apparatus or hair cutting apparatus with an elongated housing including a cutting end portion of said housing, with an electric drive mechanism and with at least one cutter assembly comprised of cooperating cutter blades combining to form a cutting edge, said cutter blades reciprocating with respect to each other on opposite sides of a plane passing between said blades, and with a spacer comb having at least one engagement surface associated with the cutting edge and formed by tines, with a relative distance to the cutting edge being adjustable by selective displacement of the engagement surface into different operative cutting positions associated with different relative distances, said cutter assembly being located at said cutting end portion of said housing, wherein the engagement surface is movable relative to the cutting edge in a horizontal direction X transverse to said cutting edge and parallel to said plane passing between said cutter blades and at the same time in a vertical direction Y, wherein the vertical direction Y is perpendicular to said horizontal direction X, said engagement surface maintaining its orientation in the X and Y axis during said movement.

2. The dry shaving apparatus or hair cutting apparatus as claimed in claim 1, wherein the engagement surfaces are curved such that the relative distances of the engagement surfaces to the cutting edge are substantially the same in an initial position of the spacer comb in which the engagement surface is closest to the cutting edge.

3. The dry shaving apparatus or hair cutting apparatus as claimed in claim 1, wherein the engagement surface is formed by the envelope surface of a cylinder.

4. The dry shaving apparatus or hair cutting apparatus as claimed in claim 1, wherein the relative distance of the engagement surface to the cutting edge is continuously variable.

5. The dry shaving apparatus or hair cutting apparatus as claimed in claim 1, wherein the relative distance of the engagement surface to the cutting edge is variable in steps.

6. The dry shaving apparatus or hair cutting apparatus as claimed in claim 1, wherein the engagement surface is of a planar configuration.

7. The dry shaving apparatus or hair cutting apparatus as claimed in claim 1, wherein the spacing of the engagement surface with respect to the cutting edge is adjustable by means of a control device.

8. The dry shaving apparatus or hair cutting apparatus as claimed in claim 1, wherein the control device includes components of the spacer comb and an actuating member associated therewith.

9. The dry shaving apparatus or hair cutting apparatus as claimed in claim 8, wherein the spacer comb is formed of a housing, a movably mounted comb attachment incorporating tines of said spacer comb, the actuating member, detent members and control members.

10. The dry shaving apparatus or hair cutting apparatus as claimed in claim 1, wherein a guard member is integrally formed on the spacer comb.

11. The dry shaving apparatus or hair cutting apparatus as claimed in claim 1, wherein at least one end of the engagement surface is formed by the respective outer wall of the tines and is configured as a tooth.

12. The dry shaving apparatus or hair cutting apparatus as claimed in claim 1, wherein each tine of said comb attachment has at least one tooth forming the boundary for the engagement surface.

13. The dry shaving apparatus or hair cutting apparatus as claimed in claim 1, wherein the spacer comb has two rows of tines.

14. The dry shaving apparatus or hair cutting apparatus as claimed in claim 13, wherein one of the two rows of the parallel tines is adjustable in both the direction X and the direction Y.

15. A dry shaving apparatus or hair cutting apparatus with an elongated housing including a cutting end portion of said housing, with an electric drive mechanism and with at least one cutter assembly comprised of cooperating cutter blades combining to form a cutting edge, and with a spacer comb having at least one engagement surface associated with the cutting edge and formed by tines, with a relative distance to the cutting edge being adjustable by displacement of the engagement surface, the apparatus including a locking mechanism to lock said tines into different cutting positions associated with different relative distances, said cutter assembly being located at said cutting end portion of said housing, wherein the engagement surface is movable relative to the cutting edge in a horizontal direction X transverse to said cutting edge and at the same time in a vertical direction Y, wherein the vertical direction Y extends along a length of said housing including said cutting end portion, wherein the control device includes components of the spacer comb and an actuating member associated therewith, wherein the spacer comb is formed of a housing, a movably mounted comb attachment incorporating tines of said spacer comb the actuating member, detent members and control members, wherein the control members comprise control grooves extending obliquely to the vertical direction Y as well as obliquely to the horizontal direction X, and control cams slidably guided in said control grooves.

16. The dry shaving apparatus or hair cutting apparatus as claimed in claim 15, wherein said comb attachment includes a front panel, and a said obliquely extending control groove is provided in said front panel of the comb attachment, and a said control cam engaging within said control groove is provided on the actuating member.

17. The dry shaving apparatus or hair cutting apparatus as claimed in claim 16, wherein said comb attachment has narrow side walls, and said two control cams are provided on the narrow side walls of the comb attachment for engagement within the control grooves extending obliquely to each other.

18. The dry shaving apparatus or hair cutting apparatus as claimed in claim 16, wherein said comb attachment has a control plate with opposed narrow side walls, and the obliquely extending control grooves are provided in said opposed narrow side walls of said control plate, said control plate being insertable into the housing.

19. The dry shaving apparatus or hair cutting apparatus as claimed in claim 18, wherein the control plate includes a horizontally extending slot for engagement with a control cam provided on the actuating member.

20. The dry shaving apparatus or hair cutting apparatus as claimed in claim 19, wherein said detent members cooperate with each other and are provided on the control plate and on the actuating member.

21. The dry shaving apparatus or hair cutting apparatus as claimed in claim 20, wherein the detent members on the control plate are configured as notches.

22. The dry shaving apparatus or hair cutting apparatus as claimed in claim 21, wherein the detent members on the actuating member are formed of an elastic bow part provided with detent noses.

23. A dry shaving apparatus or hair cutting apparatus with an elongated housing including a cutting end portion of said housing, with an electric drive mechanism and with at least one cutter assembly comprised of cooperating cutter blades combining to form a cutting edge, and with a spacer comb having at least one engagement surface associated with the cutting edge and formed by tines, with a relative distance to the cutting edge being adjustable by displacement of the engagement surface, said cutter assembly being located at said cutting end portion of said housing, wherein the engagement surface is movable relative to the cutting edge in a horizontal direction X transverse to said cutting edge and at the same time in a vertical direction Y, wherein the vertical direction Y extends along a length of said housing including said cutting end portion, said engagement surface being movable in substantially equal amounts in the vertical direction Y and the horizontal direction X.

24. The apparatus of claim 23, further comprising a locking mechanism to lock said times into different cutting positions associated with different relative distances.

25. A dry shaving apparatus or hair cutting apparatus with an elongated housing including a cutting end portion of said housing, with an electric drive mechanism and with at least one cutter assembly comprised of cooperating cutter blades combining to form a cutting edge, and with a spacer comb having at least one engagement surface associated with the cutting edge and formed by tines, with a relative distance to the cutting edge being adjustable by selective displacement of the engagement surface into different operative cutting positions associated with different relative distances, said cutter assembly being located at said cutting end portion of said housing, wherein the engagement surface is movable relative to the cutting edge in a horizontal direction X transverse to said cutting edge and at the same time in a vertical direction Y, wherein the vertical direction Y is perpendicular to said horizontal direction X and the X direction extends from said housing outward in a direction of said cutting edge, said tines of said spacer comb including vertically depending wall portions that are located in front of said cutting edge in said X direction when said tines are in said different cutting positions.

26. The apparatus of claim 25 wherein said cutter blades reciprocate with respect to each other on opposite sides of a plane passing between said blades, and said horizontal X direction is parallel to said plane passing between said cutter blades.

27. The apparatus of claim 1 or 25, further comprising a locking mechanism to lock said times into said different cutting positions.

28. The dry shaving apparatus or hair cutting apparatus as claimed in claim 1, 23 or 25 wherein said engagement surface is substantially flat, and said engagement surface and cutting edge are oriented such that a perpendicular line that divides the engagement surface in essentially two halves also extends through the cutting edge and the engagement surface is displaceable substantially in the direction of said perpendicular line.

29. The dry shaving apparatus or hair cutting apparatus as claimed in claim 1, wherein there are two said engagement surfaces that are in planes that intersect each other and are oriented at angle to each other, said two engagement surfaces being slidable substantially along a line that passes through said intersection and bisects the angle between said planes.

30. The dry shaving apparatus or hair cutting apparatus as claimed in claim 1, 23 or 25 wherein the engagement surface is of an arcuate configuration.

31. The dry shaving apparatus or hair cutting apparatus as claimed in claim 1, 23 or 25 wherein the engagement surface is of an L-shaped configuration.

32. The dry shaving apparatus of claim 1, 28, 2, 29, 7, 9 or 25 wherein said engagement surface is movable in substantially equal amounts in the vertical direction Y and the horizontal direction X.

* * * * *